US005113196A

United States Patent [19]

Ponce de Leon et al.

[11] Patent Number: 5,113,196

[45] Date of Patent: May 12, 1992

[54] LOOP ANTENNA WITH TRANSMISSION LINE FEED

[75] Inventors: Lorenzo A. Ponce de Leon, Lake Worth; Kazimierz Siwiak, Coral Springs; Michael P. Goldenberg, Boynton Beach, all of Fla.

[73] Assignee: Motorola, Inc., Schaumburg, Del.

[21] Appl. No.: 297,151

[22] Filed: Jan. 13, 1989

[51] Int. Cl.[5] ..... H01Q 7/00

[52] U.S. Cl. ..... 343/744; 343/702; 343/848

[58] Field of Search ..... 343/702, 741, 744, 748, 343/846, 848, 829

[56] References Cited

U.S. PATENT DOCUMENTS

| | | | |
|---|---|---|---|
| 2,578,154 | 12/1951 | Shanklin | 343/744 |
| 3,680,127 | 7/1972 | Richard | 343/748 |
| 4,506,267 | 3/1985 | Harmuth | 343/744 |
| 4,625,212 | 11/1986 | Oda et al. | 343/702 |
| 4,814,776 | 3/1989 | Caci et al. | 343/702 |
| 4,862,181 | 8/1989 | Ponce de Leon | 343/702 |

OTHER PUBLICATIONS

QST, Jun. 1986, vol. LXX No. 6, "Small, High Efficiency Loop Antennas" pp. 33-36.

*Primary Examiner*—Michael C. Wimer
*Attorney, Agent, or Firm*—Daniel K. Nichols

[57] ABSTRACT

A loop antenna includes a circuit board having a ground plane layer. A formed loop is located on one side of the circuit board and a transmission line is located on the opposite side of the circuit board. Capacitors interconnect the ends of the formed loop and the transmission line. The transmission line is a microstrip formed by the ground plane layer in a microstrip portion.

The circuit board includes RF circuitry that is located on the side of the circuit board opposite to the transmission line so that the ground plane shields the circuitry from the transmission line.

4 Claims, 1 Drawing Sheet

LOOP ANTENNA WITH TRANSMISSION LINE FEED

BACKGROUND OF THE INVENTION

This invention relates to antennas in general and particularly to an antenna that can be used in a miniature portable radio receiver, such as a pager receiver.

Conventional loop antennas for use at high UHF Frequencies such as 930 MHz in a miniature receiver are difficult to resonate and feed. When the loop area, or aperture, is made sufficiently large to obtain reasonable efficiency, the loop inductance is so large that an unreasonably small capacitor is required to resonate it.

One known UHF loop antenna useful in the 440 to 460 Mhz range comprises smaller loop aperture in parallel with a larger loop aperture; so that the aperture area is substantially determined by the larger loop aperture while the reactance is determined substantially by the smaller loop aperture. In that way a capacitive resonating and feeding network (using capacitors of realistic value) can be utilized. That design does not scale to the 930 MHz band conveniently since the mechanical arrangement is complicated and the antenna becomes too cumbersome for simple and automated assembly.

Another known antenna is fed by a shunt transmission line. In that antenna, feeding and matching are accomplished by extending the center conductor of a coaxial line along a portion of a loop circumference. Such a feed and match is simple and effective if it is mechanically stable.

SUMMARY OF THE INVENTION

A loop antenna includes a ground plane. A loop portion of the antenna is located on one side of the ground plane and has opposed ends. A transmission line portion of the antenna is located on the opposite side of the ground plane and has opposed ends. A first capacitance means interconnects first ends of the loop portion and the transmission line portion and a second capacitance means interconnects second ends of the loop portion and the transmission line portion.

In one aspect of the invention, the transmission line is partially formed by the ground plane. In another aspect of the invention, the transmission line is formed by the ground plane and the microstrip portion. In another aspect of the invention, one of the capacitance means is a variable capacitor.

In an aspect of the invention, the loop portion is formed from a flat metal strip. In another aspect of the invention, the microstrip portion if formed from a flat metal strip. In still another aspect of the invention, the ground plane is a layer of a circuit board and radio circuitry is mounted on the opposite side of the circuit board from the transmission line portion.

DESCRIPTION OF THE PREFERRED EMBODIMENT

Figure 1:
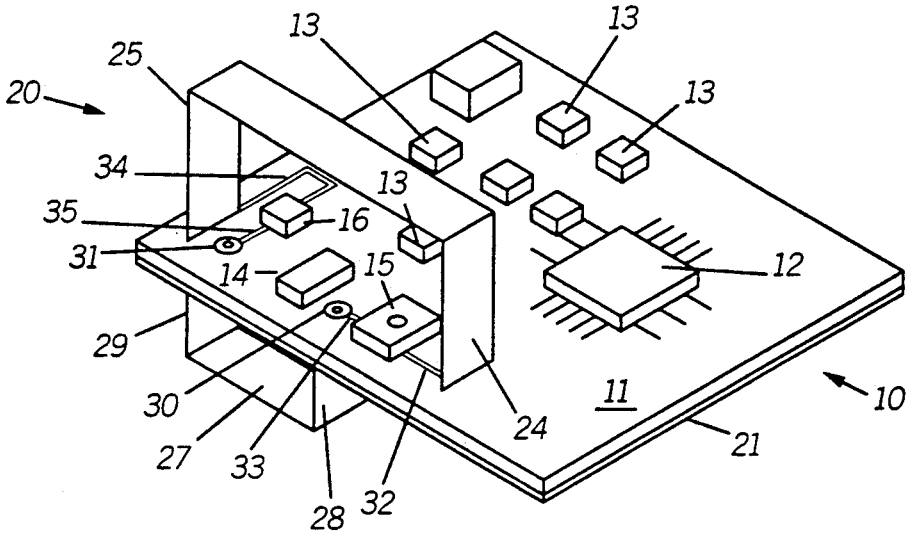
FIG. 1 is a perspective view of an antenna in accordance with the present invention
Figure 2:
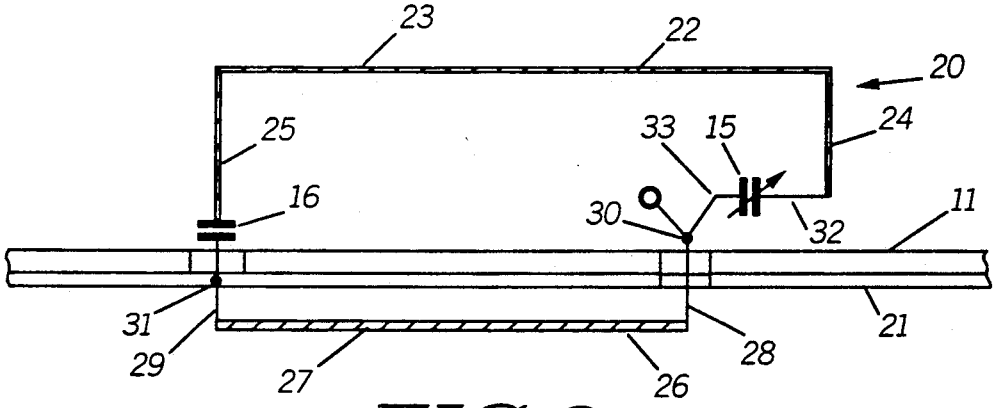
FIG. 2 is a schematic diagram of the antenna of FIG. 1.

Referring first to FIG. 1, an antenna and circuit board assembly such as a paging receiver 10 is illustrated. The receiver 10 includes a printed circuit board 11 carrying a plurality of electronic parts, such as 12, 13, 14, 15, and 16. As will be discussed, the parts 15 and 16 are capacitors used in conjunction with an antenna indicated generally by 20. The remaining parts can be conventional circuit elements such as RF and digital circuitry used for the operation of the receiver 10. In the preferred embodiment, substantially all of the parts 12–16 are located on one side of the circuit board 11. The opposite side 21 preferably is a ground plane that is used in conjunction with the antenna 20. The antenna 20 includes a formed metal element or loop portion 22 having a longitudinal section 23 and opposed end legs 24 and 25 that are both physically and electrically connected to the circuit board 11. A transmission line portion or microstrip 26 includes a longitudinal center section 27 spaced below the ground plane 21 with opposed end legs 28 and 29 providing the required mechanical and electrical connection to the circuit board 11. The electrical connections and operation of the antenna 20 can be best understood by reference to the electrical schematic diagram of FIG. 2.

The antenna loop portion 22 has its leg 24 connected to variable capacitor 15 by way of a conductive trace 32 on the circuit board 11. The other side of the capacitor 15 is connected to a feed point node 30 by conductive trace 33. Capacitor 15 provides a means for tuning the loop antenna 20.

The leg 25 at the opposite end of the antenna loop portion 22 connects to the component side of circuit board 11 and then through conductive trace 34 to one side of capacitor 16. The other side of capacitor 16 is connected via a circuit trace 35 and a through hole in the circuit board 11 to the ground plane 21 at grounding node 31. Capacitive reactances are thereby disposed at nearly opposite ends of the antenna loop portion 22 with the capacitors 15 and 16 located on the same side of circuit board 11 for ease of manufacture.

The transmission line portion 26 comprises a microstrip transmission line, whereby the microstrip ground is ground plane 21 of circuit board 11. The leg 28 end of microstrip 26 connects via a through-hole connection in circuit board 11 to the feed node 30. The leg 29 end of microstrip 26 is connected to the ground node 31.

The loop antenna 20 is thus formed by the series connection of capacitor 15, antenna loop portion 22, capacitor 16, and transmission line portion 26. The remaining end of capacitor 15 and the transmission line portion 26 are joined at the feed node 30. Feed node 30 presents a nominally 50 ohm impedance with reference to the circuit board ground plane 21. The feed node 30 is connected to the input circuitry of the associated radio pager receiver 10 in a conventional manner.

In the preferred embodiment, the antenna loop portion 22 and transmission line portion 26 are made from a flat conductive material such as beryllium copper, which is preferably plated to protect the base material and to provide ends suitable for soldering or similarly joining to the prefabricated circuit board 11.

The antenna loop portion 22 is formed by bending the flat conductive material to form three sides of a rectangle, the longitudinal section 23 and end legs 24 and 25. In the preferred embodiment the longitudinal section 23 is 28.5 mm long and the end legs 24 and 25 are of sufficient length to locate the longitudinal section 23 at a distance of 9 mm from the circuit board 11. The end legs 24 and 25 are pre-formed and narrowed in width at their respective ends so that they can each be inserted into circuit board 11 to a predetermined depth, as may be required for automated assembly procedures. When inserted into the circuit board 11, the loop portion 22 is substantially perpendicular to the plane of the circuit board.

The microstrip portion 26 is similarly formed by bending flat conductive material to form three sides of a rectangle. The end legs 28 and 29 are similarly prepared for automatic insertion into the circuit board 11.

In the preferred embodiment, the microstrip longitudinal portion 27 is 16 mm long and end legs 28 and 29 provide a 0.5 mm gap between the longitudinal portion 27 and the ground plane 21 of circuit board 11. The longitudinal portion 27 is essentially parallel to the circuit board 11 and ground plane 21.

In the preferred embodiment, capacitor 15 is variable between about 1.4 and 3 picofarads. The capacitor 15 has a fixed capacitance of 1.2 picofarads. That choice of fixed and variable capacitors along with the previously specified loop dimensions allow for tuning and adjustment of the loop resonant frequency within the range 800 MHz to 960 MHz.

As will be apparent to those skilled in the arts, capacitors 15 and 16 may be mounted on either side of circuit board 11 with substantially equal electrical performance. The radio receiver circuitry is disposed primarily on the upper side of the circuit board 11 so that the ground plane 21 of the circuit board shields the microstrip portion 26 from the receiver circuitry. In the preferred embodiment, the microstrip transmission line portion 26 acts as a feeding and impedance matching section for the receiver input circuitry.

Figure 3:
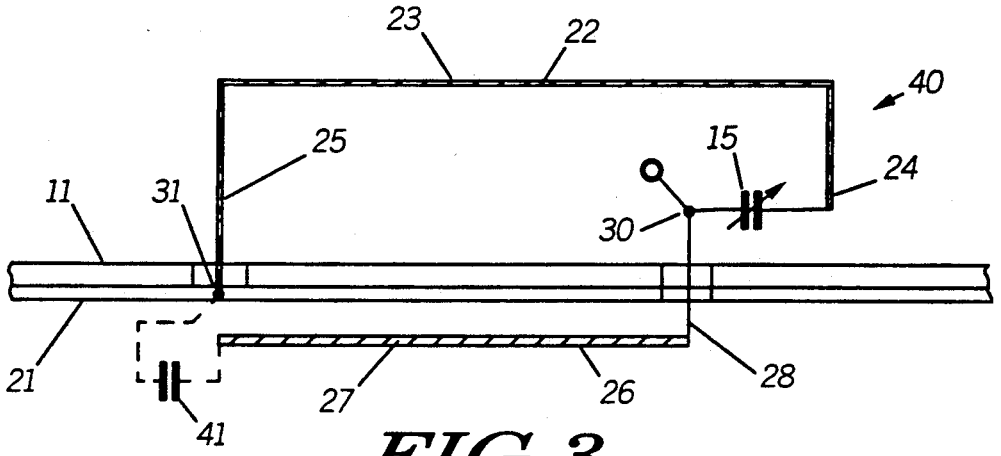
FIG. 3 is a schematic diagram of another antenna embodiment in accordance with the present invention.

Now referring to FIG. 3, another antenna embodiment 40 of the present invention is illustrated. The reference numbers of the embodiment of FIG. 2 have been retained for those elements which are common.

This embodiment differs from the previous embodiment only in the termination of end leg 25 of loop portion 22 at the ground node 31, and in the termination of the microstrip portion 26 at the ground node 31.

In this embodiment, antenna loop portion end leg 25 is connected directly to the ground node 31 of circuit board 11. The microstrip portion 26 capacitively couples to the ground node 31 of circuit board 11 as represented by the capacitive coupling 41 between the end of longitudinal portion 27 and the ground plane 21.

The loop antenna 40 is formed by the series connection of capacitor 15, antenna loop portion 22, capacitance 41 and microstrip portion 26. The remaining ends of capacitor 15 and the microstrip portion 26 are joined at the feed node 30.

If desired, the capacitors of antennas 20 and 40 could each be replaced by two or more capacitors connected in series so as to realize a required capacitance value, or so as to provide a higher voltage breakdown level. The higher voltage breakdown level may be required if such an antenna were to be used in transmitting applications. While from a manufacturing stand point it is desirable to utilize formed flat members for loop portion 22 and microstrip portion 26, they could be formed with other cross-sectional configurations, as for example circular.

We claim as our invention:

1. A loop antenna comprising:

a ground plane, a loop portion located on one side of the ground plane and having opposed ends, a transmission line portion located on the opposite side of the ground plane and having opposed ends, a first capacitance means interconnecting first ends of the loop portion and the transmission line portion, a second capacitance means interconnecting second ends of the loop portion and the transmission line portion; and the transmission line portion being a microstrip formed by the said ground plane and a microstrip line portion.

2. A loop antenna as defined in claim 1 in which;

the microstrip line portion is formed from a flat metal strip.

3. A loop antenna comprising:

a ground plane, a loop portion located on one side of the ground plane and having opposed ends, a transmission line portion located on the opposite side of the ground plane and having opposed ends, a first capacitance means interconnecting first ends of the loop portion and the transmission line portion, a second capacitance means interconnecting second ends of the loop portion and the transmission line portion:

the ground plane being a layer of a circuit board, and the circuit board including radio circuitry mounted on the opposite side of the circuit board from the transmission line portion.

4. A loop antenna as defined in claim 3 in which; the first and second capacitance means comprises capacitors mounted on said one side of the circuit board.

* * * * *